US006582141B2

(12) United States Patent
Meier et al.

(10) Patent No.: US 6,582,141 B2
(45) Date of Patent: Jun. 24, 2003

(54) CARD CLEANING ROLLER ASSEMBLY

(75) Inventors: James R. Meier, St. Paul, MN (US); Neil E. O'Mara, Woodbury, MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 10/025,842

(22) Filed: Dec. 18, 2001

(65) Prior Publication Data

US 2002/0106229 A1 Aug. 8, 2002

Related U.S. Application Data

(63) Continuation of application No. 09/604,459, filed on Jun. 27, 2000, now abandoned.

(51) Int. Cl.[7] ..... B41J 29/17
(52) U.S. Cl. ..... 400/701; 101/425
(58) Field of Search ..... 101/425, 424, 101/423; 400/701; 15/256.5, 256.51, 256.52

(56) References Cited

U.S. PATENT DOCUMENTS

| | | | | |
|---|---|---|---|---|
| 4,006,507 A | 4/1978 | Yoshida | ..... | 15/102 |
| 4,083,302 A | 4/1978 | Bello et al. | ..... | 101/423 |
| 6,091,918 A | 4/1978 | Kellie et al. | ..... | 399/249 |
| 5,255,606 A | 10/1993 | Lijima et al. | ..... | 101/423 |
| 5,299,796 A | 4/1994 | Wooldridge | ..... | 271/9 |
| 5,401,111 A | 3/1995 | Nubson et al. | ..... | 400/701 |
| 5,588,763 A | 12/1996 | Nubson et al. | ..... | 400/700 |
| 5,802,976 A | 9/1998 | Friedrichs | ..... | 101/425 |

OTHER PUBLICATIONS

P310 Printer Instructions, Eltron International Inc., pp. 20 and 21, publication date 1998.

*Primary Examiner*—Anthonny H. Nguyen
(74) *Attorney, Agent, or Firm*—Westman, Champlin & Kelly, P.A.

(57) ABSTRACT

A card printer is provided with a cleaning roller that will pick up debris on the surface of a card on which printing is to take place. The cleaning roller has a sticky surface, that is engagement with a band of adhesive tape that moves to contact the surface of the cleaning roller and remove debris that is on the cleaning roller surface. The tape is preferably formed in an endless band mounted on a pair of rollers that are in a common housing with the cleaning roller. The housing is removably mounted in the printer, and can be opened for replacement of the band of tape.

10 Claims, 5 Drawing Sheets

CARD CLEANING ROLLER ASSEMBLY

This is a Continuation of and claims priority from application Ser. No. 09/604,459, filed Jun. 27, 2000, for CARD CLEANING ROLLER ASSEMBLY, now abandoned.

Also, cross reference is made to co-pending application Ser. No. 09/604,214, filed on Jun. 27, 2000 and entitled CARD THICKNESS SELECTION GATE FOR A CARD FEEDER, and to Ser. No. 09/604,642, filed on Jun. 27, 2000 entitled DUAL CARD FEEDER, now U.S. Pat. No. 6,431,537.

BACKGROUND OF THE INVENTION

The present invention relates to a roller assembly for cleaning the surface of a substrate, such as an identification card, on which information is to be printed or applied, and for removing debris that collects on a cleaning roller which contacts the substrate. The assembly includes an endless flexible band of pressure sensitive adhesive that engages a soft rubber roller used for picking debris off the substrate and which removes the collected debris from the substrate engaging roller.

A problem arises with printing ID cards that are removed from a card stack when there are bits of debris on the surface of the card. The debris may be small bits of material from trimming or cutting, or even an accumulation of lint, dust or other debris. The debris has to be removed in order to obtain high quality printing, and at the present time soft rubber rollers that have a sticky or adhesive outer surface are used. The soft rubber rollers roll over the surface of the card to pick up the debris. These cleaning rollers are well known and are defined as cleaning rollers having a sticky or low force adhesive outer surface.

However, the cleaning rollers may become contaminated quickly and lose effectiveness, as well as starting to miss some debris as the roller surface fills up. Changing the rollers whenever they do become contaminated is a time consuming job.

A printer made by Eltron International, Inc. of Simi Valley, Calif., has a card cleaning cartridge in their Model P310 printer. However, this cartridge includes a separate cleaning roller that will be used for moving material from a card, and can be removed and replaced when it becomes contaminated.

Additionally, Datacard Corporation of Minneapolis, Minn., has a card cleaning roller assembly that has a tape which will strip collected particular material away from the cleaning rollers after a predetermined number of cards have been cleaned. Spools of adhesive type tape are used for this arrangement. Such a device is shown in U.S. Pat. No. 5,401,111.

In the system, the tape that is used for removing debris is not driven by the cleaning rollers, but rather is driven to remove the tape at periodic intervals under a positive drive.

SUMMARY OF THE INVENTION

The present invention relates to a cleaning assembly for removing debris from the surface a card cleaning roller in a printing operation. A soft cleaning roller engages the surface of the card to be printed as is known. The cleaning roller has a sticky surface that will pick up debris from the card. An endless band or belt of substantial surface area which has a pressure sensitive adhesive on an outer surface engages the sticky surface cleaning roller on the side of the cleaning roller opposite from the card, so that any debris that adheres to the surface of the cleaning roller is removed by the pressure sensitive adhesive on the band or belt. The pressure sensitive adhesive on the endless band surface is a higher force adhesive than the cleaning roller surface. The belt has a substantial surface area so that it can be used for a length of time without changing, to thereby reduce the costs of removing debris from cards to be printed.

The belt and cleaning roller preferably are contained in a cartridge that carries the cleaning roller that runs against a card surface. A pair of tape mounting rollers that are spaced apart are supported on the cartridges. The tape mounting rollers support the belt of adhesive material. One of the tape mounting rollers is supported so the endless band of material is urged against the surface of the sticky cleaning roller. The endless band or belt having the adhesive surface will be driven to move by the cleaning roller as the sticky surface cleaning roller rotates from movement of the card it is engaging. When the endless band of adhesive surface material or tape is full of debris, the cartridge can be removed, and the endless band replaced with new band easily.

The cleaning assembly is reliable, easily used and reduces down time for servicing the cleaning rollers.

DETAILED DESCRIPTION OF THE ILLUSTRATIVE EMBODIMENTS

Figure 1:
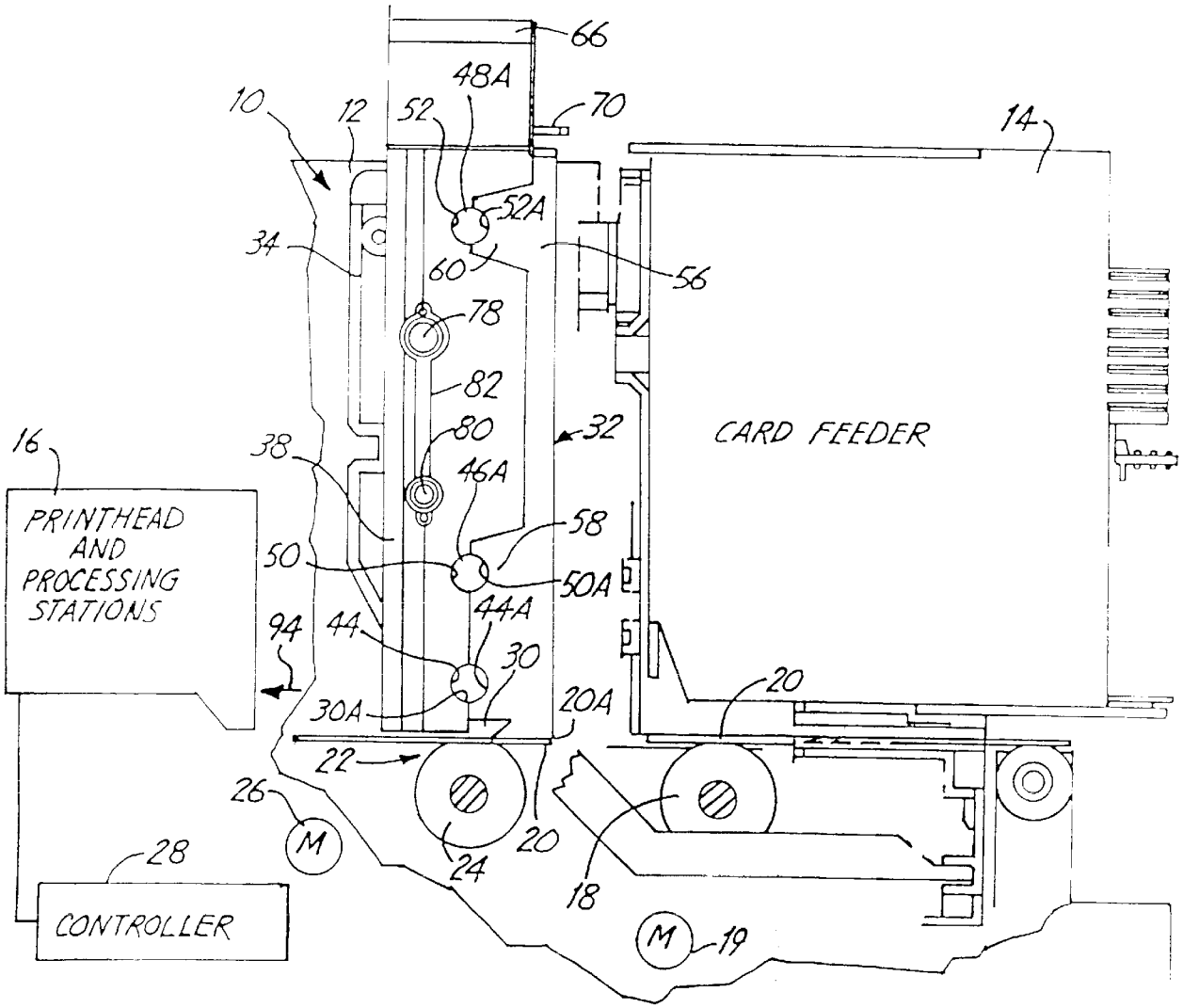
FIG. 1 is a fragmentary view of a printer having a card cleaning roller assembly made according to the present invention installed thereon with parts broken away.

In FIG. 1, a printer 10 shown fragmentarily includes side frame walls 12, and has a card feeder and hopper 14 that feeds cards into a printhead and processing station 16. The cards are fed using powered rollers such as that shown at 18, for the card feeder which is driven by a motor 19. Individual cards 20 are then fed toward the printhead and processing station 16. In the form shown the cards pass through a set of rollers 22. The cards are driven by a drive roller 24 that is driven with a suitable motor 26, under control of a central controller 28 and are engaged by a cleaning roller 30 which rolls along the top surface of the card as the card is driven through the rollers.

The controller 28 controls operations of the card feeder roller 18 and the printer and processing station 16 as well.

The lower surface of card 20 is engaged by the drive roller 24, and the upper surface 20A of the card, on which printing is to take place in the printhead in station 16, engages the cleaning roller 30, which has a sticky surface that will pick up debris on the top surface 20A. The cleaning roller 30 is preferably a soft urethane roller, known in the art and is mounted in a roller assembly cartridge 32. The cartridge 32 is a self contained housing, which in turn is slipped into suitable guides 34, on inner surfaces of the side walls 12 of the printer.

Figure 6:
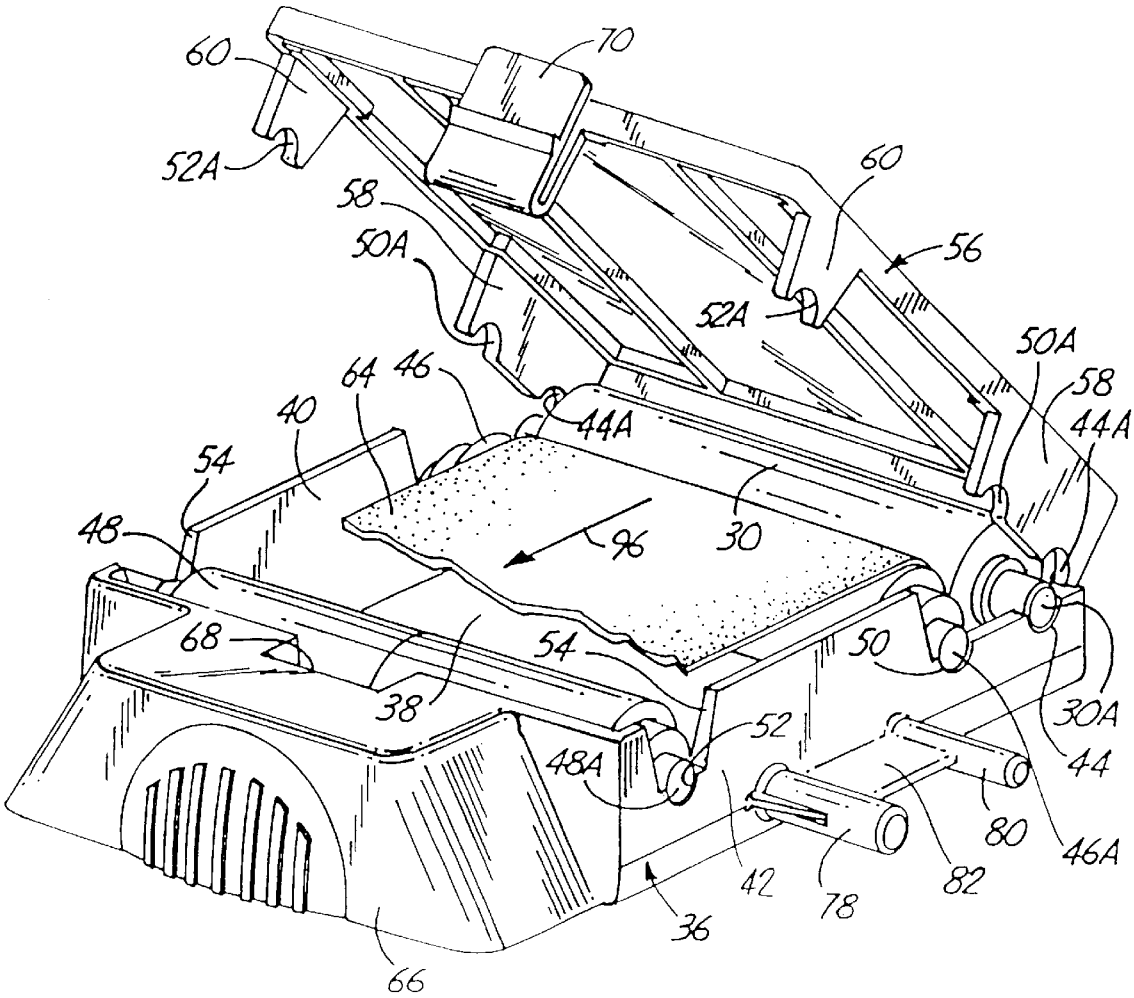
FIG. 6 is a perspective view of the cartridge of FIG. 3 with a dust cover in open position to expose the interior.

The cartridge 32 includes an outer housing 36, which is perhaps best seen in FIG. 6, that has a forward or front wall 38 (facing toward printhead 16), and sidewalls 40 and 42. The sidewalls 40 and 42 are each provided with a plurality of recesses, including a recess 44 for receiving ends of a shaft 30A of the roller 30. The housing 36 further mounts a pair of idler rollers 46 and 48, that are spaced apart in a vertical direction as shown in FIG. 1, and which have shafts 46A and 48A that are mounted in recesses 50 and 52, respectively. The recesses 50 are on the same level as the recess 44. The sidewalls 40 and 42 are relieved or cut down between recesses 44 and 50. The recesses 52, which mount the ends of roller shaft 48A are at the bottom of generally V-shaped grooves 54, on the respective sidewalls 40 and 42.

The shafts 30A, 46A and 48A are rotatably mounted in their respective recesses which form shaft supports, and are held in position with a dust cover 56 that has sidewall portions 58 including recesses 44A and 50A that mate with the recesses 44 and 50 and support the shafts 30A and 46A to hold them in place. Additionally, the dust cover 56 has wall portions 60 that include recesses 52A for overlying the shaft 48A and mating with the recesses 52 for holding the shaft ends 48A in position. The shafts 30A, 46A and 48A are all rotatably mounted in the cartridge housing 36, but are not power driven.

The rollers 46 and 48 mount an endless band or belt 64 of a film having pressure sensitive adhesive on an outwardly facing surface. It is a band of adhesive tape. The band or belt of tape is relatively wide, so that it extends substantially along the entire length of the rollers 46 and 48, so that it is wider than a card 20 that is being processed and will span the entire lateral width of the card, as will the cleaning roller 30. The band or belt of tape 64 fits in the cartridge between the sidewalls 40 and 42.

Figure 4:
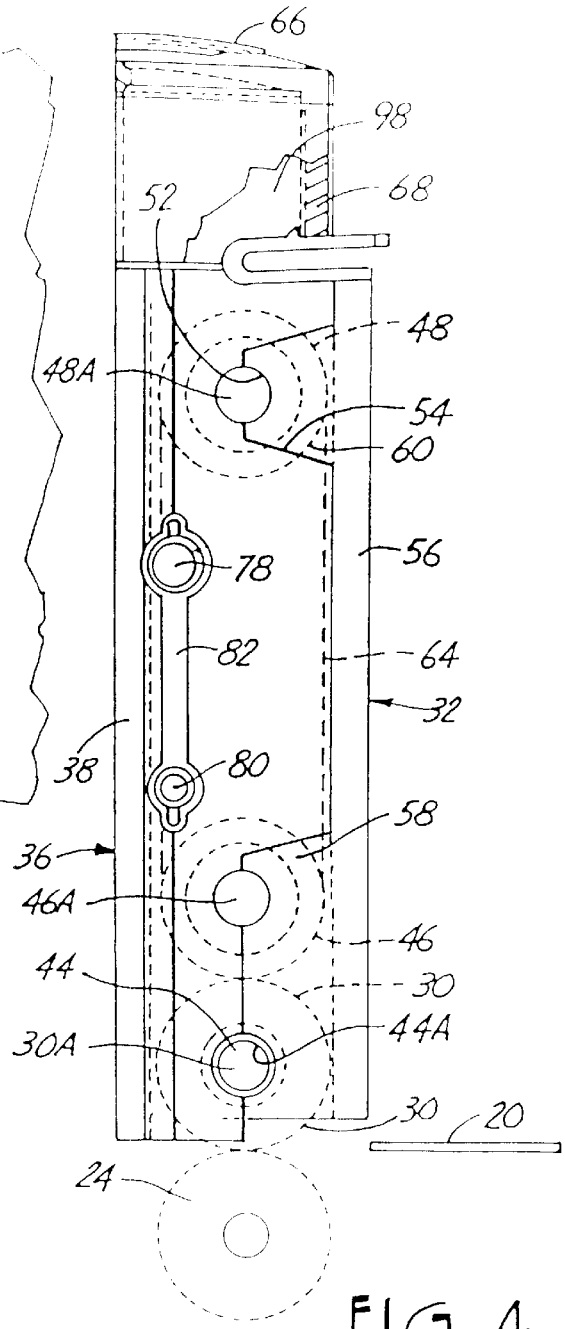
FIG. 4 is an enlarged side elevational view of the card cleaning roller assembly with parts broken away to show details of construction.
Figure 5:
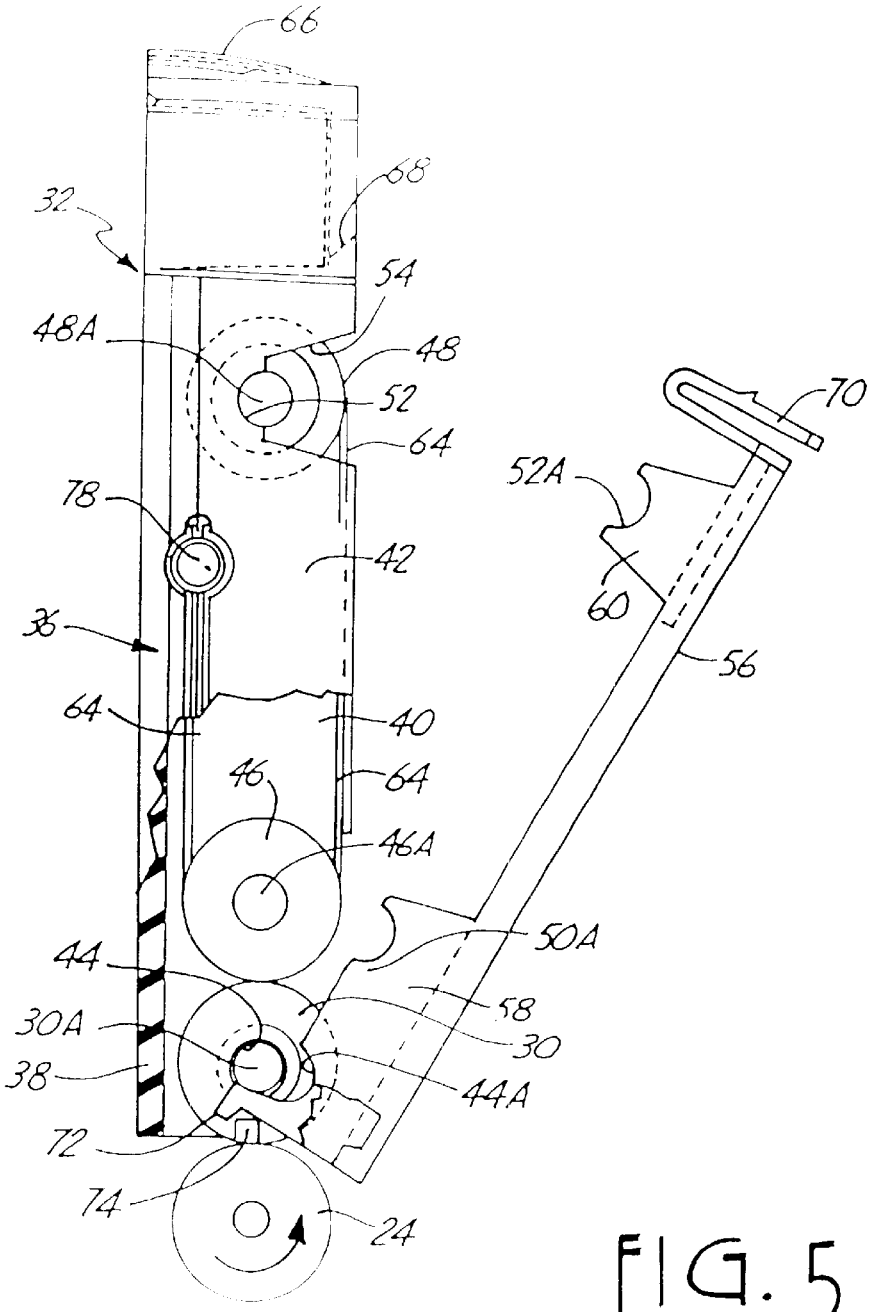
FIG. 5 is a side elevational view of the cartridge of FIG. 3 with a dust cover shown in a partially open position.

The cartridge housing 36 further has an upper end wall 66 extending between walls 40 and 42 that has a latch recess which, as shown in FIG. 4 forms a latch lug 68, that will latch against a flexible or spring latch member 70 formed on the cover 56. It can be seen that the latch member 70 can be depressed from the position shown in FIG. 4 to clear the latch lug 68 so that the cover 56 can be removed from the housing 36. Also, as shown in FIG. 5, the lower end of the cover 56, adjacent end roller 30 has small tangs 72 that fit over short cross members 74 in the housing 36. The cover 56 then can be moved out as shown in FIG. 5 and removed from the housing 36. When the cover 56 is removed the rollers 46 and 48 can also be removed, and an endless band or belt of tape 64 removed and replaced with a new band or belt of tape 64. The adhesive side of the band of tape contacts the surface of the cleaning roller 30.

Figure 2:
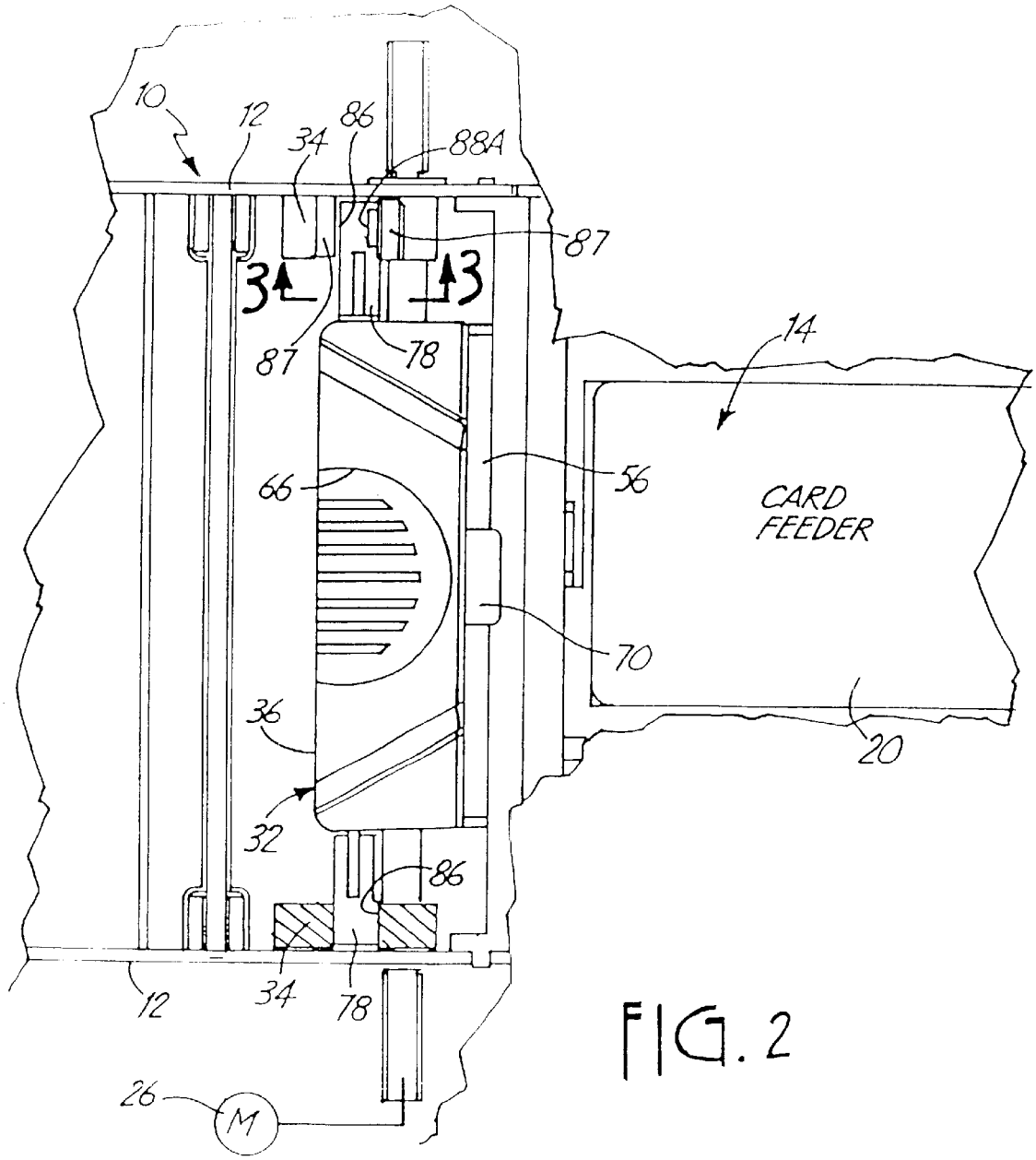
FIG. 2 is a top plan view of the card cleaning roller assembly of FIG. 1.
Figure 3:
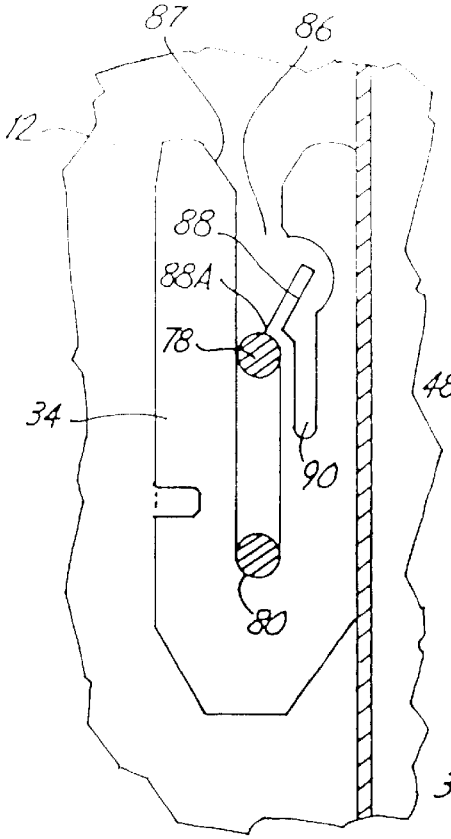
FIG. 3 is a sectional view taken as on line 3—3 in FIG. 2.

The cartridge housing 36 has mounting studs on the sidewalls for holding the housing in the mounting brackets in the printer. There are upper studs 78, and lower studs 80 that protrude from each of the sidewalls 40 and 42, respectively, and the hubs supporting the studs have suitable braces 82 between them. The studs 78 and 80 will slide into guide or retainer block 34 on each side of the printer. The guides or retainer blocks are shown in FIG. 2, and also in FIG. 3. The guides or retainer blocks 34 each are made of a suitable plastic and will mount against the respective sidewall 12, and include a slot 86 for receiving the studs 78 and 80, respectively. Additionally, there is a spring retainer latch arm 88 on one side of the slots 86, which is formed by a recess 90 that leaves the latch 88 free resiliently to slip out of the way when a cartridge 32 is inserted into the printer, and then spring back so a protrusion 88A engages the studs 78 to retain the cartridge in position. The lower studs 80 are seated at the bottom of the slots 86 so the roller 30 is close to or contacting roller 24. The latch arms 88 yield enough to permit the cartridge to release when a positive upward pull is exerted on the handle grip 98 formed on the upper wall 66.

The cartridge can be loaded with the endless band or belt of tape 64 in place, with the adhesive side contacting the cleaning roller 30. When the cartridge is held in place with the latches 88, it is in the position shown in FIGS. 1 and 4, so that the card or substrate drive roller 24 is engaged by the soft cleaning roller 30. As a card 20 is fed by the drive roller 24, it has to compress the sticky surface cleaning roller 30. This will cause cleaning roller 30 to rotate, since it is mounted in the cartridge 32 for free rotation. The rotation of roller 30 in turn will drive the endless belt of tape by friction, and rotate rollers 46 and 48. The adhesive surface of the belt of film or tape 64 will then be engaging the surface of the cleaning roller 30 and the tape will pick up debris on the surface of the cleaning roller. The debris will be carried with the tape as it is moves. For example, when the roller 30 is driving a card toward the printhead, in the direction of the arrow indicated at arrow 94, the tape would be driven as indicated by the arrow 96.

Several passes of the belt of tape can be made before it is necessary to replace the tape, because the belt has a large surface area and will pick up a substantial number of particles of debris before being contaminated and needing replacement.

The cards or substrates thus are cleaned easily and the cleaning roller also is cleaned easily, and the time needed for maintenance of the cleaning assembly is minimized.

When the belt of tape does need to be removed and replaced the cartridge 32 is easily pulled up by the hand grip 98 formed in the upper wall 66, and when the cartridge is removed, the latch 70 is depressed to clear the latch edge 68. The dust cover 56 can be pulled out. This will remove the capture walls or caps that overlie the shafts for the cleaning roller 30 as well as for the rollers 46 and 48 that mount the belt of tape, and a new tape band or belt can be put into place on those rollers. The cleaning roller 30 also can be cleaned before being replaced if desired. Then, the dust cover 56 is reclosed, and the entire cartridge 32 can be slid back into the printer effortlessly.

The printer cover (not shown), that is normally provided, will open to expose the upper wall 66 so that the cartridge 32 can be removed and replaced easily.

It should be noted also that the guides 34 have tapered ends 87 at upper ends of the slots 86, to easily guide the studs 80 and 78 into position.

The rollers 44 and 48 for the endless band of tape are crowned, so that they will compress a little in the center portion and maintain a tension on the band as well as keeping it centered. A crowned roller is a roller where the outer surface is slightly larger in the center and tapers to a slightly smaller diameter at each end. The guide studs 78 on the sides of the cartridge housing 36 are urged by protrusion 88A on the spring arm 88A to be seated in the slots 86. The arms 88 will yield for different thicknesses of cards between cleaning roller 30 and drive roller 24. The small protuberance 88A on the spring arms 88 are inclined so they maintain a load on the roller 30 toward the substrate drive roller 24. As different thicknesses of cards come in, the cartridge 32 will slide or yield upwardly enough against the load from protrusions 88A to permit the cards to pass.

Also, one of the problems is lint on the cards. Lint is removed by the cleaning roller 30, and then in turn removed from the cleaning roller 30 by the adhesive surface of the tape. The tape bands can have a release liner on the adhesive surface, so that it easily handles for installation, and then the liner can be removed when the band or film is in position on the rollers with the adhesive.

The cleaning roller can be spaced from the tape during certain times during operation and then moved to contact the tape for removal of material from the cleaning roller at other times. In other words, the engagement of the cleaning roller and tape does not have to be continuous, although continuous contact is preferred.

Although the present invention has been described with reference to preferred embodiments, workers skilled in the art will recognize that changes may be made in form and detail without departing from the spirit and scope of the invention.

What is claimed is:

1. A cleaning roller assembly cartridge for a printer that feeds a substrate into the printer, comprising a cartridge housing, a cleaning roller rotatably mounted at one end of the cartridge housing about a roller axis for engaging a surface of the substrate to be printed, said cleaning roller having a surface onto which particles will adhere, a pair of spaced film support rollers rotatably supported on the cartridge housing on axes parallel to the roller axis, an endless band of a film having a pressure sensitive adhesive surface mounted on the film support rollers engaging the cleaning roller at a location spaced from a region of engagement of the cleaning roller and the substrate, said film being driven by the cleaning roller and operating to remove debris on the surface of the cleaning roller, and laterally extending studs on the cartridge housing for engaging support members on a printer for removably mounting the cartridge housing on the printer to position the film in contact with the cleaning roller.

2. The cleaning roller assembly of claim 1, wherein said endless band has a lateral width greater than the width of a substrate that is being fed into the printer.

3. A cleaning roller assembly for a printer that feeds a substrate into the printer, comprising a housing, a cleaning roller supported in the housing for engaging a surface of the substrate to be printed, said cleaning roller having a surface onto which particles will adhere, a pair of spaced idler rollers supported in the housing, a band of film mounted over the idler rollers, the film having a pressure sensitive adhesive surface engaging the cleaning roller at a location spaced from a region of engagement of the cleaning roller and the substrate, said film being driven by the cleaning roller to move around the idler rollers, and operating to remove debris on the surface of the cleaning roller, wherein said housing has sidewalls, a back wall and an open side, a cover for said open side movably mounted on the housing to provide access to the open side, said rollers all having shafts mounted on saddle shaped receptacles formed on the side walls of the housing, the cover having covering saddle portions that hold the shafts of the rollers in position when the cover is closed.

4. The cleaning roller assembly of claim 3 and a latch for holding said dust cover in position on the housing.

5. A cleaning roller assembly for a printer that feeds a substrate into the printer, comprising a housing, the housing having sidewalls with laterally extending guides, the guides being adapted to be removably received in support members on the printer to support the housing, a cleaning roller mounted in the housing for engaging a surface of the substrate to be printed when the guides are received in the support members, said cleaning roller having a surface onto which particles will adhere, a pair of spaced apart idler rollers mounted in the housing, and a band of film having a pressure sensitive adhesive surface mounted over the idler rollers, the film engaging the cleaning roller at a location spaced from a region of engagement of the cleaning roller and substrate, said film surface engaging the cleaning roller and being driven by the cleaning roller and operating to remove debris on the surface of the cleaning roller.

6. The cleaning roller assembly of claim 5, wherein the guides on the sidewalls are configured to be held by spring catches on the support members to removably hold the housing in a position wherein the cleaning roller will engage a surface of the substrate to be printed.

7. The cleaning roller assembly of claim 5, wherein the idler rollers have center shafts, and the housing has an openable cover, the idler rollers being mounted on shaft supports in the housing that are opened when the cover is opened to permit the idler rollers to be removed from the housing.

8. The cleaning roller assembly of claim 5, wherein the housing has an openable cover extending between the sidewalls to provide an opening between the sidewalls, said rollers all having shafts mounted on saddles formed on the sidewalls that are opened to permit removal of the rollers when the cover is opened, the cover having wall portions that cover the saddles to hold the shafts of the rollers in position when the cover is closed.

9. A cleaning roller assembly cartridge for a printer that feeds a substrate into the printer, comprising a cartridge housing, a cleaning roller rotatably mounted at one end of the cartridge housing about a roller axis for engaging a surface of the substrate to be printed, said cleaning roller having a surface onto which particles will adhere, a pair of spaced film support rollers rotatably supported on the cartridge housing on axes parallel to the roller axis, an endless band of a film having a pressure sensitive adhesive surface mounted on the film support rollers engaging the cleaning roller at a location spaced from a region of engagement of the cleaning roller and the substrate, said film being driven by the cleaning roller and operating to remove debris on the surface of the cleaning roller, and guides on the cartridge housing for mating with support members on a printer for removably mounting the cartridge housing on the printer, the support members including slots, and the guides on the cartridge housing engaging the slots, said film support rollers and said cleaning roller all have axes lying on a common plane.

10. A roller cleaner assembly for a printer having a frame, a card cleaning roller, the roller cleaner removing debris and lint from the outer surface of the card cleaning roller, a cartridge housing removably mounted on the frame, the frame and cartridge housing having co-operations guide members that interfit to position the cartridge housing in a working position on the frame, the card cleaning roller being rotatably mounted in the housing with a portion exposed for engaging a card, a pair of spaced support rollers mounted in the housing, an endless band of flexible film having a pressure sensitive adhesive surface mounted on the support rollers with the pressure sensitive adhesive surface facing outwardly, said card cleaning roller being supported in the cartridge housing in contact with the pressure sensitive adhesive surface, when the cartridge housing is in its working position, so that as said card cleaning roller rotates the endless band of film is driven by the outer surface of the card cleaning roller in a path defined by the support rollers.

* * * * *